US012497741B2

(12) United States Patent
Abresch et al.

(10) Patent No.: US 12,497,741 B2
(45) Date of Patent: Dec. 16, 2025

(54) MOUNTED EARTH REMOVAL DEVICE HAVING A SPLIT SIDE PLATE

(71) Applicant: Wirtgen GmbH, Windhagen (DE)

(72) Inventors: Stefan Abresch, Dierdorf (DE); Marcel Joisten, Neuwied (DE)

(73) Assignee: Wirtgen GmbH, Windhagen (DE)

( * ) Notice: Subject to any disclaimer, the term of this patent is extended or adjusted under 35 U.S.C. 154(b) by 280 days.

(21) Appl. No.: 18/093,363

(22) Filed: Jan. 5, 2023

(65) Prior Publication Data

US 2023/0250597 A1 Aug. 10, 2023

(30) Foreign Application Priority Data

Feb. 9, 2022 (DE) ..... 10 2022 103 022.9

(51) Int. Cl.
*E01C 23/088* (2006.01)

(52) U.S. Cl.
CPC ..... *E01C 23/088* (2013.01)

(58) Field of Classification Search
CPC ..... E01C 23/088; E02F 3/20; E02F 3/188
See application file for complete search history.

(56) References Cited

U.S. PATENT DOCUMENTS 4,536,636 A 8/1985 Opprecht et al.
4,803,789 A 2/1989 Hackmack
(Continued)

FOREIGN PATENT DOCUMENTS

CN 1113090 A 12/1995
CN 103282583 A 9/2013
(Continued)

OTHER PUBLICATIONS

European Search Report for corresponding patent application No. 23154856.1, dated Jul. 7, 2023, 7 pages (not prior art).
(Continued)

*Primary Examiner* — Carib A Oquendo
(74) *Attorney, Agent, or Firm* — Lucian Beavers; Patterson Intellectual Property Law PC

(57) ABSTRACT

The present invention relates to a mounted earth removal device (10), comprising:

a work drive (16), which is designed for rotation about a work axis (A), and a device housing (12) having a support part (14), on which the work drive (16) is accommodated, the device housing (12) having a base structure (30), of which the support part (14) forms at least a section, the device housing furthermore having a first side plate (18) and a second side plate (70) running crosswise to the work axis (A), the first side plate (18) and the second side plate (70) respectively have a first and a second ground contact section (76), each ground contact section (36, 76)

contacting the earth during earth removal work, and being accommodated relative to the base structure (30) so as to be translatorily displaceable crosswise to the work axis (A) and swivable about a swivel axis (P1, P2).

The invention provides that at least one side plate (18, 70) includes a lift component (32, 72) displaceable relative to the base structure (30) in translatory fashion crosswise to the work axis (A) and a swivel component (34, 74) that is displaceable together with the lift component (32, 72) in translatory fashion and that is swivable relative to the lift component (32, 72) about the swivel axis (P1, P2), the ground contact section (36, 74) of the side plate (18, 70) being indirectly connected to the lift component (32, 72).

21 Claims, 6 Drawing Sheets

(56) References Cited

U.S. PATENT DOCUMENTS

| | | | | |
|---|---|---|---|---|
| 5,373,902 | A | 12/1994 | Lindblom | |
| 5,381,616 | A | 1/1995 | Disney | |
| 5,382,084 | A | 1/1995 | Diver et al. | |
| 6,116,699 | A | 9/2000 | Kaczmarski et al. | |
| 7,665,806 | B2 | 2/2010 | Rotz et al. | |
| 8,002,360 | B2 | 8/2011 | Cochran et al. | |
| 9,127,417 | B2 | 9/2015 | Risi | |
| 9,328,467 | B2 | 5/2016 | Forster et al. | |
| 10,358,793 | B2 | 7/2019 | Risi | |
| 10,443,209 | B2 | 10/2019 | Kumbhar et al. | |
| 11,313,087 | B2 | 4/2022 | Berning et al. | |
| 2007/0116519 | A1 | 5/2007 | Haroldsen | |
| 2007/0284933 | A1* | 12/2007 | Rotz | E01C 23/088 299/39.4 |
| 2008/0246328 | A1 | 10/2008 | Mannebach et al. | |
| 2009/0232598 | A1 | 9/2009 | Cochran et al. | |
| 2013/0322963 | A1 | 12/2013 | Forster et al. | |
| 2014/0042794 | A1* | 2/2014 | Risi | E01C 23/088 299/39.4 |
| 2017/0254046 | A1* | 9/2017 | Risi | E02F 3/183 |
| 2017/0328018 | A1* | 11/2017 | Mannebach | E01C 23/127 |
| 2023/0025097 | A1 | 1/2023 | Sishtla et al. | |

FOREIGN PATENT DOCUMENTS

| | | | |
|---|---|---|---|
| CN | 219471044 | U | 8/2023 |
| DE | 1206936 | B | 12/1965 |
| DE | 9407487 | U1 | 7/1994 |
| DE | 10105475 | C1 | 5/2002 |
| DE | 1102004035876 | B3 | 12/2005 |
| DE | 202010010857 | U1 | 11/2010 |
| DE | 102013221566 | A1 | 4/2015 |
| EP | 681063 | A2 | 11/1995 |
| EP | 1222333 | A1 | 7/2002 |
| EP | 2495367 | B1 | 6/2015 |
| EP | 3350373 | B1 | 9/2021 |
| GB | 2512945 | A | 10/2014 |
| JP | 2001073318 | A | 3/2001 |
| JP | 2004285745 | A | 10/2004 |
| WO | 9105915 | A1 | 5/1991 |
| WO | 0116429 | A1 | 3/2001 |
| WO | 0125545 | A1 | 4/2001 |
| WO | 2012116821 | A1 | 9/2012 |

OTHER PUBLICATIONS

Corresponding co-pending U.S. Appl. No. 17/890,448, filed Aug. 18, 2022 (not prior art).

Corresponding co-pending U.S. Appl. No. 17/890,431, filed Aug. 18, 2022 (not prior art).

Exhibit A—3 sheets of drawings of a dual drive milling attachment (undated but admitted to be prior art).

Bobcat Parts Manual, cover and pp. 149-152, (2010) showing a dual drive milling attachment.

Bobcat Standard Flow Planer, Operations & Maintenance Manual for s/n 231200101 & above, cover and pp. 14 & 18, (2000) showing Ski Height Adjustment, Cutting Concrete, Cutting Asphalt and Planing a General Area.

Bobcat Planer Wheel Saws, Parts Manual vol. 4 Attachments, cover and p. 185-186, & 188, (2010) showing part number for Housing Group 14" 231200101 & above.

Bradco Operator's and Parts Manual 16", 18", 24", 30" & 40" High Flow Cold Planers with 3-Function Control and Selector Valve f or Skid Steer Loaders, Manual No. OM667, Part No. 75567, Rev. 6 (2010), 65 pages.

Bradco Operator's and Parts Manual HP400/HP450/HP600/H{750/HP1000 Cold Planers for Skid-Steer Loaders, Manual No. OM666, Parts No. 75566, Rev. 3, 66 pages (undated but admitted to be prior art).

Bobcat Planers Wheel Saws vol. 4 Attachments Parts Manual, Main Frame Parts List, (2001) 8 pages.

Bradco Bulletin, John Deere Skid Steer Bulletin No. 07SS06, (2007) Product and Training Information Bulletin, 3 pages.

Bradco Operator's Manual CP12C, CP18C, CP24C and CP30C Cold Planers, OMT229749 Issue H9, 60 pages (undated but admitted to be prior art).

Roadhog Cold Planers Spec Sheet May 2020, 1 page.

Bobcat Planner Attachment, Features & Benefits, Product Overview, Compatible Models and Specifications, 4 pages (undated but admitted to be prior art).

Photo excerpted from https://www.youtube.com/watch?app=desktop&v=ZkjiOPulnyw Milling / Cold Planing Attachments—Schibeci Range Publication—Oct. 6, 2008.

Photos excerpted from https://www.youtube.com/watch?app=desktop&v=nTfewSk2Ne0 Bobcat Planer Attachment | Bobcat Equipment Publication—Mar. 10, 2010.

China Office Action for corresponding patent application No. 2025032900304020, dated Mar. 29, 2025, 7 pages (not prior art).

* cited by examiner

MOUNTED EARTH REMOVAL DEVICE HAVING A SPLIT SIDE PLATE

CROSS-REFERENCES TO RELATED APPLICATIONS

This application claims benefit of German Patent Application No. DE 10 2022 103 022.9 filed Feb. 9, 2022, the details of which are incorporated herein by reference.

BACKGROUND

Field of the Disclosure

The present invention relates to a mounted earth removal device for releasable connection to a work vehicle. The mounted earth removal device, also abbreviated below as "earth removal device", comprises:

- a work drive having an output component, the output component being designed both for torque-transmitting coupling to a removal tool rotating in removal operation as well as for rotation about a work axis, the work axis defining an axial direction running along the work axis, radial directions running orthogonally relative to the work axis and a circumferential direction running about the work axis, and
- a device housing having a support part, on which the work drive is accommodated, the device housing having a base structure, of which the support part forms at least a section, the device housing further having a first side plate running crosswise to the work axis and a second side plate running crosswise to the work axis at an axial distance from the first side plate, the first side plate having a first ground contact section and the second side plate having a second ground contact section, each ground contact section of the first and the second ground contact sections

- being designed for contact with the earth to be worked during earth removal work of the mounted earth removal device, and
- being accommodated so as to be displaceable relative to the base structure in translatory fashion crosswise to the work axis and swivable about a swivel axis enclosing an angle of no more than 25° together with the work axis.

Description of the Prior Art

Such a mounted earth removal device is known from EP 1 222 333 B1 (U.S. Pat. No. 6,623,083) or from WO 2001/025545 A belonging to the same family.

The side plates of this known earth removal device are formed in one piece and are also formed in one piece with the ground contact section. The known side plates are able to be moved orthogonally to the work axis by way of a lift pin, guided in a first slot hole, of an eccentric lever, swivable relative to the base structure, of a lift drive. The removal depth is also adjusted by the swiveling displacement of the lift pin. During a removal operation, the ground contact section of a side plate contacts the earth to be worked. The measure, by which the removal tool protrudes beyond the ground contact section out of the device housing, determines the removal depth.

The known side plates have a second slot hole, into which a guide pin fixed on the base structure engages. The guide pin fixed on the base structure and the lift pin of the eccentric lever run in parallel. The curved slot holes, into which the two pins respectively engage, run in a manner rotated relative to each other about an axis of rotation parallel to the pins so that the two pins define the position of an essentially plane side plate orthogonal to the extension direction of the two pins relative to the base structure. The two slot holes, into which the two pins respectively engage, are curved about a common axis of curvature. The side plates are therefore able to rotate relative to the base structure about the axis of rotation, the maximally possible angle of the rotation being predefined by the length of the shortest slot hole.

The design of the known side plates and base structure is such that the axis of curvature of the slot holes ideally coincides with the work axis. As a result, a self-propelled work vehicle, which carries the mounted earth removal device during an earth removal operation, is able to incline in a pitching movement about the pitch axis, which often happens in such earth removal operations, without this pitching movement changing the effective removal depth of the earth removal device. Under the influence of the work vehicle inclining about the pitch axis, the side plates defining the removal depth rotate about the swivel axis defined by the common axis of curvature of the two slot holes. The closer the swivel axis is to the work axis, the smaller is the effect of the pitching movement on the removal depth.

Due to the sliding coupling of pins and curved slot holes, the side plates in the known earth removal device are able to perform, relative to the base structure supporting the work drive, only either a purely rotary passive movement, driven by the described pitching movement of the work vehicle, or a combined translatory and rotary movement effected by the lift drive.

A further mounted earth removal device is known from EP 3 350 373 B1 (U.S. Pat. No. 10,358,793). The side plate of the latter also has slot holes, in which a lift pin and a guide pin are accommodated and guided in a sliding manner. This side plate is thus also able to change position relative to the base structure. The difference between this earth removal device and the previously mentioned earth removal device is that the guide pin of this earth removal device is situated coaxially relative to the work axis so that only the slot hole of the side plate, into which the lift pin engages, is curved, while the slot hole, into which the guide pin engages is a rectilinear slot hole.

As further related art, reference is made to DE 101 05 475 C1, which discloses a trench milling machine having a side plate in the shape of a cylinder sector that is swivable only about the work axis. The exclusively swivable side plate is swiveled by a slide bracket about a swivel axis parallel to the work axis. The slide bracket is hinged on a support arm of the base structure of the trench milling machine at a distance from the work axis for the exclusive swivel movement about a bracket swivel axis parallel to the work axis. The slide bracket in turn is coupled by an articulated lever to the swivable side plate. The milling depth of the known trench milling machine is achieved by limiting the swivel movement path of the slide bracket. In this case, it is not the swivable side plate, but rather the slide bracket that has a ground contact section. The side plate itself of the known trench milling machine normally has no contact with the earth during an earth removal operation.

The ground contact sections of the side plates are subject to high wear due to their contact with the ground and due to their proximity to the removal tool, which, during a removal operation, ejects at high speed abrasive grains removed from what is often mineral earth material. A replacement of worn ground contact sections always requires a replacement of the entire side plate. Due to the fact that the side plate is normally made of steel, this replacement is painstaking and requires much force, possibly by using lifting devices.

SUMMARY OF THE DISCLOSURE

It is therefore an object of the present invention to develop a mounted earth removal device of the species in such a way that it is able to be used in a more flexible manner and is easier to maintain or to repair.

This object is achieved in a mounted earth removal device of the kind mentioned at the outset in that at least one side plate of the first and the second side plates is developed in multipart fashion and includes a lift component displaceable relative to the base structure in translatory fashion crosswise to the work axis and a swivel component that is displaceable in translatory fashion together with the lift component and that is swivable relative to the lift component about the swivel axis, the ground contact section of the side plate being connected to the lift component indirectly via the swivel component situated in between.

Due to the multipart development of the side plate, it suffices advantageously, in the event that a ground contact section needs to be replaced, that only the component of the side plate having the ground contact section is replaced, while other components of the side plate, which are normally subject to less wear than the ground contact section, may remain on the device housing. Thus, it is possible, for example, for the lift component, which by its position relative to the base structure determines the setting of the removal depth of the earth removal device in removal operation, to remain on the device housing, since the ground contact section is not developed directly on the lift component but is rather connected to it only indirectly.

The mounted earth removal device is briefly explained in its basic construction as follows:

The work drive is preferably a motor having a rotary output member, in particular having an output shaft. The work drive is preferably a hydraulic motor. As a variant, the work drive may also be an electric motor or a combustion engine.

Normally, regardless of its physical mode of operation, the work drive is supplied with drive energy by the work vehicle. For this purpose, the mounted earth removal device preferably has appropriate lines and line couplings, which are couplable with corresponding mating couplings on the work vehicle for transmitting energy. The line couplings may be for example couplings of hydraulic lines or of electrical lines.

The output component is a component driven by the work drive, via which drive energy may be transmitted to the removal tool. In a particularly simple case, the output component may be an output shaft of the work drive provided for rotation. Preferably, the output component is a flange coupled for joint rotation with the drive shaft, to which for the transmission of torque a removal tool particularly suitable for the respective removal task may be connected and will be connected for fulfilling removal tasks.

The removal tool may be a milling drum, having a drum casing, which is fitted with cutting tools, for example with milling bits. In removal operation, the milling bits are then rotated about the work axis and by engaging in the earth remove material from the latter. The milling drum comprises, preferably radially within its drum casing, a connecting flange, by which it is, preferably releasably, connectable to the drive com ponent.

Alternatively, the removal tool may be a cutting wheel, a cutting or saw blade or a plurality of cutting or saw blades situated in the axial direction at a distance from one another. Such a removal tool also has a connecting flange, preferably radially within its cutting circle. A single cutting or saw blade is chosen if only one cut is to be performed in the earth, for example to lift a slab of soil as a whole from the ground. The plurality of cutting or saw blades arranged at a distance from one another may be used for example to work a desired surface structure into the surface of the earth, such as for example parallel grooves of a predetermined groove depth.

Since the present invention essentially concerns the design of at least one side plate, it does not matter whether or not the earth removal device fundamentally designed to accommodate a removal tool actually has a removal tool.

The torque-transmitting coupling between the removal tool and the output component is preferably established via releasable connecting means, for example by using at least one screw component, for example by using a plurality of threaded pins arranged in the circumferential direction at a circumferential distance from one another and at a radial distance from the work axis, as is also known from coupling vehicle wheels to the wheel hub of the vehicle. Alternatively, to reduce the installation work when installing or changing a removal tool, it is possible to use a central screw component, whose screw axis is coaxial to the work axis, such as a central threaded pin or a central nut for fixating the removal tool on the output component.

The device housing essentially serves to protect the surroundings of the earth removal device against removal grains, which are cut out of the earth material by the removal tool and are immediately upon being cut out ejected at high speed in all possible directions from the location of removal.

The support part, which supports the work drive, serves as the coordinate origin of the device housing. Every movement of components of the device housing is described in the present application as a relative movement relative to the support part or to the base structure formed in combination with the support part. The base structure comprises the support part and all further components of the device housing rigidly connected to the support part, regardless of whether these are connected in one piece with the support part or are indirectly or directly mounted on the support part. The support part may be for example an arm and/or a plate, on which the drive motor is accommodated and supported in torque-resistant fashion.

The device housing may furthermore comprise a protective shell, which extends at a distance from the work axis in the circumferential direction across a circumferential section around the work axis. The protective shell then surrounds at a radial distance the cutting tools on the removal tool rotating about the work axis. Since the removal tool must be able to engage with the earth, the protective shell does not surround the removal tool in circumferentially closed fashion, but merely across a circumferential section that is smaller than a full circle. The protective shell thus surrounds a receiving space for accommodating the removal tool. The protective shell is preferably at least partially part of the base structure, although it may comprise components, such as service flaps for example, that are movable relative to the base structure. The support part may be situated for example on an axial end area of the protective shell. A removal tool connected to the drive component then protrudes from it axially on one side. In the case in which there is only one cutting or saw blade, the axially one-sided protrusion extends only over the thickness of the blade. In the case of a milling drum or of the plurality of cutting or saw blades described above, the axially one-sided protrusion may result in a considerable tilting moment, however, which must be supported appropriately by constructive measures.

The protective shell, if present, is located axially between the first and the second side plate. The side plates preferably axially border the receiving space of the removal tool surrounded by the protective shell on both sides of the receiving space. The support part and/or generally a section of the base structure, as for example a rigid housing wall oriented crosswise to the work axis and connected to the protective shell, may be located axially between a side plate and the receiving space. On the side of the work drive or on the axial side of the receiving space of the removal tool situated closer to the work drive, a section of the base structure bounding the receiving space may be formed having an opening axially penetrating through the section, in order to accommodate for example the work drive in the opening or in order to conduct operating fluids, such as for example hydraulic fluid and/or lubricants and/or coolants through the opening. This is advantageous in particular if the work drive is situated entirely or partially in the receiving space of the removal tool.

On the basis of their relative position relative to the base structure and thus relative to the work axis, the side plates of the presently discussed mounted earth removal device determine the removal depth, at which the removal tool in removal operation removes earth material starting from the earth surface facing the earth removal device. For this reason, the translatorily displaceable lift component of the at least one side plate is connected preferably in a self-locking manner to a lift drive for the translatory adjustment of the lift component. The lift component and thus the side plate is then able to be translatorily displaced only by the lift drive, but not by a force exerted by the base structure on the side plate, such as for example a force due to the weight of the base structure and possibly a force of weight component of a work vehicle connected to the earth removal device and/or a removal reaction force of the removal tool.

The self-locking connection between the lift component and an output part of a lift drive may be achieved by the choice of a contact angle between the lift component and the output part as a function of the material pairing between the lift component and the output component and thus as a function of effective coefficients of friction between the mentioned components. This contact angle may be the lead angle of a screw drive if the lift drive comprises a screw drive. The contact angle may also be the lead angle of an edge of a slot hole, into which the lift pin engages and along which edge the lift pin slides during a translatory displacement of the lift component, for example if the lift drive has an eccentric lever already known for this purpose in the related art. Although in this latter case the lift pin is preferably supported on the eccentric lever and protrudes from the latter, particularly preferably orthogonally with respect to the translatory movement direction of the lift movement, it shall not be excluded that the slot hole may be formed on the eccentric lever and that the lift pin protrudes from the lift component.

Alternatively, the translatory fixation of the lift component relative to the base structure may be achieved by the lift actuator, in that the lift actuator is locked for movement. This may be implemented by a form-locking engagement or a friction-locking engagement of a locking member switchable between a locking engagement and a release position with an output member of the lift actuator. In the preferred hydraulic lift actuator, this may be achieved by appropriate switchable shutoff valves, which cut off the hydraulic pressure prevailing in the lift actuator or the hydraulic fluid present in the lift actuator from the hydraulic oil circuit fundamentally connected to the hydraulic lift actuator.

The side plates not only determine the removal depth of the earth removal device in the respective removal operation, but also axially close as much as possible possibly existing gaps between the base structure of the surface of the earth to be worked. Due to the adjustability of the removal depth, the existence of such a gap between the base structure and the earth surface is nearly unavoidable.

Although it shall not be excluded that at least one intermediate component is situated between the swivel component and the lift component, which is coupled on one side to the lift component and on its other side to the swivel component, for the purpose of reducing the installation effort, it is preferred for producing the earth removal device that the swivel component is supported directly on the lift component so as to be swivable about the swivel axis. For this purpose, a component made up of the lift component and the swivel component may have at least one curved slot hole, preferably a plurality of curved slot holes, into which respectively a guide pin protruding from the respectively other component of the lift component and the swivel component projects. The curvature of the at least one slot hole is chosen in such a way that the axis of curvature of the at least one slot hole, preferably of the plurality of slot holes, is the swivel axis of the swivel component. Additionally or alternatively, the swivel component may be supported on the lift component in swivable fashion via a swivel pin forming a swivel bearing, the axis of the swivel pin being coaxial with respect to the swivel axis. In this instance, it is a matter of free choice whether the lift component supports the swivel pin and the swivel component supports a sliding bushing surrounding the swivel pin or vice versa.

The at least one guide pin preferably has a sliding section surrounded by the slot hole and a locking section, the locking section having a greater dimension, in particular a diameter, orthogonal to the guide pin axis than the sliding section and a greater dimension orthogonal to the guide pin axis than the slot hole penetrated by the sliding section. The sliding section of a guide pin is then situated along the guide pin axis between the locking section and the component supporting the guide pin. Due to the locking section, the guide pin is able to absorb and support transverse forces acting along the work axis. Hence, to improve the ability to absorb transverse forces, preferably more than one guide pin having a sliding section and a locking section are provided, particularly to avoid tilting moments resulting from transverse forces in the forward motion direction of the earth removal device on both sides of a plane that contains the work axis and is orthogonal to the surface of the earth to be worked. When the earth removal device is not connected to a work vehicle, the forward motion direction and the orientation of the surface of the earth to be worked may be recognized on the respective ground contact section of the side plate. A ground contact section normally has a contact surface designed for contact with the earth to be worked and/or support contact points designed for contact with the earth to be worked. The forward motion direction is then a direction running parallel to the contact surface or parallel to a virtual ground surface defined by the totality of the support contact points running orthogonally to the work axis. The ground surface is determined directly by the contact area or by the mentioned virtual ground surface.

The pivot pin, if present, may also have a locking section, which has a greater dimension, in particular a diameter, orthogonal to the pivot pin axis than a sliding opening, in particular a sliding bushing, penetrated by the pivot pin, so that the pivot pin is also able to absorb transverse forces acting in the direction of the work axis. The sliding opening, in particular the sliding bushing, is then situated along the longitudinal axis of the pivot pin between the component supporting the pivot pin and the locking section of the pivot pin.

In principle, it may be provided that between the pivot component and the ground contact section at least one further component is provided, which is connected to the pivot component on the one hand and to the ground contact section on the other hand. Again, for the purpose of reducing the expenditure of installation and components, it is preferred that the swivel component comprises the ground contact section.

The ground contact section may be mounted on the swivel component or may be integrally connected to the swivel component, for example by welding, or may be formed in one piece with the swivel component, for example as the end face of a plate-shaped swivel component.

In principle, it is further conceivable that at least one further intermediate component is provided between the lift component and the base structure, so that the lift component is directly guided on the intermediate component in translatorily displaceable fashion and thereby has a translatory relative mobility with respect to the lift component. With the objective of producing the presently discussed earth removal device with the least possible expenditure of material and installation, it is preferred, however, that the lift component is guided on the base structure in a translatorily displaceable fashion. For this purpose, at least one guide formation may be provided on the base structure, which interacts with a mating guide formation on the lift component. The guide formation may be developed in one piece with the base structure, either by milling a guide groove into a surface of the base structure facing the lift component, or the guide formation may be implemented on a guide component that is mounted on the base structure. The same applies, mutatis mutandis, to the mating guide formation on the lift component.

Although in principle a translatory roller body guide is conceivable between the base structure and the lift component, a translatory sliding guide between the lift component and the base structure is preferred on account of the normally occurring dirt load on the lift component and the base structure.

Although the translatory moving direction may be inclined with respect to the work axis, for example if the device housing is designed so as to widen toward its emergence opening of the removal tool facing the earth in the removal operation, it is preferred if the lift component is translatorily displaceable orthogonally to the work axis in order to avoid reactions of forces action along the work axis on the translatory displaceability of the lift component.

For an effective adjustment of the removal depth with a short lift travel, the lift component is preferably translatorily displaceable crosswise, particularly preferably orthogonally, to the emergence opening of the removal tool and thus to the location of the removal engagement of the removal tool with the earth.

Alternatively or preferably additionally, it is for the same reason preferred that the swivel axis is oriented in parallel or coaxially to the work axis. In the sense of the present application, two axes are coaxial if the axes are parallel with a distance of 0 between them.

In principle, it is not necessarily excluded that the lift component is able to perform a further relative movement with respect to the base structure apart from the translatory displacement movement. A clear functional separation is advantageous, however, according to which the removal depth is clearly adjustable by the lift component and a secure sealing of the engagement zone of the removal tool is ensured by the swivel component. The first may be achieved in that the lift component is displaceable relative to the base structure only in translatory fashion. The second may be achieved in that the swivel component is movable relative to the lift component only in swiveling fashion.

In order to facilitate the exchangeability of the ground contact section, be it due to wear or for the purpose of selecting a ground contact section that is particularly suitable for the respective removal task, it is preferred that the component of the side plate supporting the ground contact section is designed to be smaller than the lift component. This facilitates both the stockage of ground contact sections as well as their installation due to the smaller size and thus lesser weight. As explained above, it is preferred that the ground contact section is provided on the swivel component, particularly preferably integrally connected to the swivel component for reasons of stability. Thus, the fact that the swivel component is smaller than the lift component may be expressed simply by saying that the surface of the swivel component facing away from the base structure in the direction of the swivel axis is less than 40%, preferably less than 30%, of the surface of the lift component facing away from the base structure in the direction of the swivel axis. As essentially planar components, the surface facing in the direction of the swivel axis is a good measure for the size and the weight of the respective component.

In the related art, it is always preferred that the swivel axis of the ground contact section is as close as possible to the work axis, preferably being coaxial with respect to the work axis. The advantageous use of a swivel component that is as small as possible, however, makes it difficult to situate the swivel axis coaxially with respect to the work axis. Sufficient sealing of the engagement zone of the removal tool with respect to the external surroundings, however, may also be achieved in that in a translatory displacement of the lift component across its entire operational displacement path, the swivel axis is always situated on the same side of a threshold plane containing the work axis that is orthogonal to a projection of the translatory displacement path along the work axis. The lift movement of the lift component changes the position of the swivel axis relative to the threshold plane, the swivel axis preferably being always situated at a distance from the threshold plane, even in the case of the greatest possible approach of the swivel axis to the threshold plane by exhausting the maximally possible lift travel. Although, due to the given distance between the swivel axis and the threshold plane, a pitching movement of a work vehicle connected to the earth removal device for removal work results in an effective change of the engagement depth of the removal tool into the earth, these changes are tolerable in terms of the ratio to the set removal depth, in particular because the presently discussed mounted earth removal devices are normally used for rather rough removal work, in which a strict planeness of the worked earth following the removal by the earth removal device is not quite so important.

The "operational lift travel" refers to the maximally possible lift travel during a removal operation. This shall not exclude that for installation purposes a lift travel differing from the operational lift travel is available.

A lift drive was already discussed above, which may be provided on the earth removal device in order to displace the lift component and thus the side plate in translatory fashion. For the purpose of saving space, it may be advantageously provided for the base structure to support a lift actuator, whose output member cooperates with the lift component of the at least one multipart side plate, in order to displace the lift component in translatory fashion in opposite directions. In particular the protective shell as part of the base structure offers sufficient receiving space for accommodating the lift actuator. The lift actuator is preferably situated on the outside of the protective shell, in particular, with respect to the work axis, on the side of the earth removal device opposite the emergence opening for the removal tool for engaging the earth. The lift actuator may be an electric motor, for example having a spindle drive or screw drive. The lift actuator is preferably a fluid-operated piston-cylinder system. This lift actuator having a linear-translatorily movable output member, whether it be a spindle or a piston rod, is able to swivel an eccentric lever hinged in swiveling fashion on the base structure about an eccentric swivel axis parallel to the swivel axis, in particular also to the work axis, and is thus able to displace a formation of slot hole and lift pin developed on the eccentric lever at a distance from the eccentric swivel axis, in order thereby to displace the lift component provided with the respectively other formation of slot hole and lift pin in translatory fashion relative to the base structure. The lift pin is preferably situated on the eccentric lever and the slot hole is situated on the lift component, preferably as a straight, uncurved slot hole that is simple to produce.

While for adjusting the removal depth, the lift component is moved by the lift actuator specifically into a desired position relative to the base structure and is retained there, as described above, for relieving the lift actuator, preferably by self-locking, the swivel component is preferably supported on the rest of the device housing, in particular on the lift component, in a passively swiveling manner relative to the lift component. Thus, the swivel component is able to ensure the sealing of the engagement location of the removal tool, since it is readily displaced relative to the lift component by an external action of force, for example by a pitching movement of the connected work vehicle.

Preferably, not only one side plate is designed in the manner described above, but rather both side plates of the device housing are designed and developed as described above. Everything that was said above about the at least one side plate may therefore be implemented on each of the two side plates. Thus it is possible for both the first lift component of the first side plate to be supported in translatorily displaceable fashion relative to the base structure by a first linear guide device having a first guide distance, i.e. first guide clearance, to be measured orthogonally to the translatory displacement path as well as the second lift component of the second side plate to be supported in translatory displaceable fashion relative to the base structure by a second linear guide device having a second guide distance, i.e. second guide clearance, to be measured orthogonally to the translatory displacement path. The respective guide distances or guide clearances are formed between partial guide formations of a linear guide formation, in particular the sliding guide already mentioned above, in order to avoid unwanted stick-slip and/or jamming effects in the translatory displacement of the lift component. The work axis, possibly imagined to be extended, preferably runs between the partial guide formations of a linear guide device of a side plate, preferably of every side plate, in order to keep the effects of tilting moments acting about the work axis between the lift component the base structure as low as possible.

For the purpose of simplifying manufacture and installation, the first and the second side plate may comprise identical parts. Preferably, the first and the second lift components are identical parts and/or the first and the second swivel components are identical parts. If the first and the second ground contact sections are respectively implemented on contact components developed separately of the swivel components supporting them, such contact components may also be identical parts.

Since the two side plates are mounted with the same orientation on different or axially opposite sides of the base structure, the use of identical parts is substantially facilitated if these are developed in essentially planar fashion and in mirror symmetry with respect to a mirror symmetry plane that is parallel to their plane of extension. It is then possible to mount a component from both sides identically on another component or on the base structure.

The construction of the first linear guide of the first side plate, in particular of the first lift component, on the base structure preferably differs from the construction of the second linear guide of the second side plate, in particular of the second lift component, on the base structure. Particularly preferably, the first guide distance differs from the second guide distance in terms of absolute value in order to take into account the different constructional circumstances on the two side plates. As was already explained above, at least the energy supply of the work drive runs on an axial side of the device housing through the respective side plate, in particular through its lift component. On the other axial side of the device housing, the side plate may be developed by a greater or lesser guide distance so as to make the receiving space of the work tool in the device housing accessible in order to be able to remove the work tool axially from the receiving space and to be able to insert it into the receiving space and connect it to the drive component.

The ground contact section may comprise skids which rest in a sliding manner with their contact surfaces facing the ground on the surface of the earth to be worked. Alternatively or additionally, the ground contact section may comprise at least one roller, which rolls on the surface of the earth to be worked during the removal operation. To avoid unwanted wear of the ground contact section in the case of particularly abrasive earth surfaces, the ground contact section may have a plurality of rollers rolling on the earth surface, each roller resting with its respective support contact point in a rolling manner, or ready to roll, on the earth surface.

The use of skids, which at least in the case of an integral connection with the swivel component for the aforementioned reasons may project beyond the swivel component on both sides preferably symmetrically, does not impede the fundamentally planar design of the swivel component. For functional reasons, the skids are normally situated at the edge of the swivel component in order to achieve secure ground contact during removal operation.

A roller as ground contact section is preferably mounted on the swivel component, particularly preferably in releasable fashion. When using identical swivel components, a roller may be mounted on the identical swivel component as the ground contact section from both sides of the identical swivel component.

Since the drive vehicle supporting the earth removal device, in addition to its intended forward motion, may perform not only a pitching movement about a pitch axis, but also further movements, such as a rolling movement about its roll axis, which should likewise not result in the ground contact sections being lifted off the ground, the earth removal device preferably comprises a coupling assembly having a coupling formation, the coupling assembly including the coupling formation being designed for releasable coupling to a self-propelled work vehicle, the coupling assembly being connected to the base structure in a movable manner relative to the base structure. The relative mobility of the coupling assembly relative to the base structure may comprise a rotatability about an axis of rotation that is orthogonal to the work axis. In an earth removal device that is connected to a work vehicle, the work axis normally runs parallel to the pitching axis of the work vehicle so that the mentioned axis of rotation runs parallel or primarily parallel to the roll axis of the work vehicle.

The earth removal device or at least the base structure may be actively adjusted by a rotary actuator as incline actuator about the axis of rotation as incline axis, which is orthogonal to the work axis, and be held in this inclined position, for example in order to obtain, after removal, a worked surface in the earth that is inclined with respect to the forward motion direction as it is produced about the incline axis parallel to the forward motion direction.

The incline axis crosses or preferably intersects the work axis. The crossing point or intersection is preferably at the position of the axial longitudinal center of the respective removal tool. As a result, an inclination of the base structure at identical angles of inclination in terms of absolute value in both possible inclination directions starting from a neutral position at an angle of inclination of 0° to the pitch axis of the work vehicle supporting the earth removal device has an identical effect.

Alternatively, such an inclination may also be achieved by setting different translatory displacement positions in terms of absolute value, particularly lift positions, of the first and of the second side plate relative to the base structure. For when the ground contact sections of the two side plates displaced differently in translatory fashion rest on the earth to be worked, the work axis is inclined about the incline axis parallel to the forward motion direction as a function of the difference of the translatory displacement positions. For this purpose, in order to prevent unwanted overdeterminations due to their unpredictable reactive forces, it is advantageous if the inclination actuator acting about the incline axis that is orthogonal to the work axis is then held in a floating position without effect of force if the inclination of the earth removal device or of its base structure and thus of its work axis is to be determined by the different translatory displacement positions of the side plates.

Since the side plates determine the removal depth of the removal tool during an earth removal operation due to their translatory displacement position relative to the base structure, the two side plates should normally not be set simultaneously to be without effect of force by their respective lift actuators, so that both are translatorily displaceable relative to the base structure by an external effect of force. In this case, the ensuing removal depth would always be the maximally possible removal depth of the earth removal device.

In the event of a desired earth removal at an inclined work axis, which is adjusted relative to the ground surface about an axis of inclination parallel to the forward motion direction into an inclined position deviating from parallelism, this may also be achieved, apart from the two specific quantitatively different translatory displacement positions of the two side plates with an inclination actuator set to be without force effect, by setting a defined translatory displacement position of only one side plate, by setting a defined inclined position of the base structure using the inclination actuator and by setting the lift actuator of the respectively other side plate to be without effect of force. A translatory displacement position of the respectively other side plate may then set in freely under the given boundary conditions.

When it is desired to set lift actuators specifically to be without effect of force in order to allow for a translatory displacement position of a side plate to set in freely under the given external influences, this side plate is preferably not coupled to its associated lift actuator in self-locking fashion, since otherwise the self-locking would scotch the desired free adjustability of the translatory displacement position of the side plate relative to the base structure on the basis of the effects prevailing on the side plate.

The relative mobility of the coupling assembly relative to the base structure may alternatively or preferably additionally include a translatory displaceability of the base structure relative to the coupling assembly along a displacement path running along the work axis. When viewing the earth removal device, attached to a work vehicle, when the work vehicle is standing on a horizontal flat surface, the displacement path runs parallel to the work axis and normally also to the pitch axis of the work vehicle.

A tilting mechanism, which provides the above-described tilting mobility of the base structure about a tilt axis orthogonal to and preferably intersecting the work axis, is preferably displaceable together with the base structure along the work axis. This makes it possible to ensure that the relative axial position of the axis of inclination relative to the work axis does not change as a result of a lateral displacement of the base structure along the work axis.

The present invention also relates to a self-propelled work vehicle having a mounted earth removal device, as described and developed above, releasably coupled to the work vehicle. An earth engagement area of the earth removal device for a removing earth engagement is preferably located outside of a ground area enclosed by the ground contact points of the traveling gear of the work vehicle. This makes it in principle possible to use the weight of the work vehicle in order to apply a load onto the earth removal device and in particular its removal tool in the direction of the earth to be worked.

The work vehicle preferably has a manipulation frame that is movable relative to the vehicle frame, in particular swivable about the pitch axis and/or translatorily movable along the yaw axis, to which the earth removal device is directly attached. In the case of a multi-axle work vehicle, which is more likely to be the rule rather than the exception, by lowering the manipulation frame toward the earth to be worked, it is possible to lessen the load on the vehicle axle situated nearer to the earth removal device and thus to increase the load on the earth removal device toward the earth.

BRIEF DESCRIPTION OF THE DRAWINGS

The present invention will be explained in greater detail below with reference to the attached figures. The figures show.

DETAILED DESCRIPTION OF THE DISCLOSURE

Figure 1:
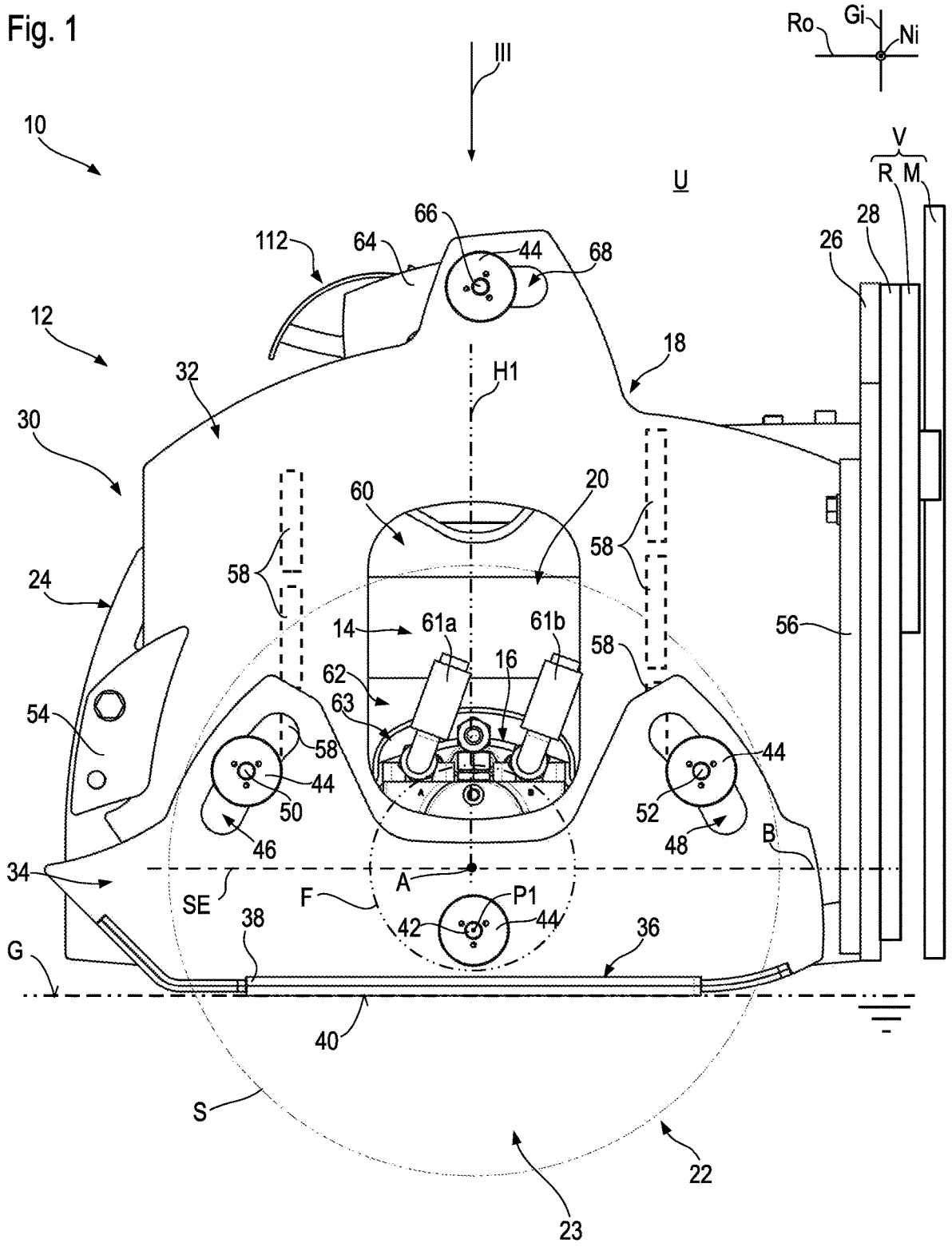
FIG. 1 an elevation view of a specific embodiment according to the invention of a mounted earth removal device with a direction of view along the work axis onto the first side plate in its completely raised operating position, FIG. 2 an elevation view of the specific embodiment according to the invention of the earth removal device of FIG. 1 with a direction of view along the work axis onto the second side plate axially opposite the first side plate in its completely raised operating position, FIG. 3 a top view onto the specific embodiment according to the invention of the earth removal device of FIGS. 1 and 2 with a direction of view orthogonal to the work axis and orthogonal to the surface of a ground intended for earth removal, FIG. 4 a view corresponding to FIG. 1, but with a completely lowered first side plate, FIG. 5 a view corresponding to FIG. 2, but with a completely lowered second side plate, and FIG. 6 a top view corresponding to FIG. 3, but with completely lowered first and second side plates.

In FIGS. 1 through 6, a specific embodiment of a mounted earth removal device according to the invention is generally designated by 10. The earth removal device 10 comprises a device housing 12 having a housing wall 14 in parallel to the drawing plane of FIG. 1 as a support part. The housing wall 14 supports a work drive 16 in the exemplary form of a hydraulic motor. In FIG. 1, in front of the rigid housing wall 14, a first side plate 18 is located having a central opening 20, through which the viewer of FIG. 1 is able to discern the work drive 16 and a section of housing wall 14.

Device housing 12 accommodates a milling drum 22 as a removal tool in a manner rotatable about a work axis A that is orthogonal to the drawing plane of FIG. 1. Milling drum 22 is indicated by its cutting circle S, which represents the track of the working tips of cutting tools, for example milling bits, in the rotation about work axis A. Instead of the milling drum 22, the removal tool could comprise a cutting blade or a saw blade. This too would be represented in the same manner by its cutting circle in FIGS. 1, 2, 4 and 5 as the milling drum 22.

The work drive 16 drives a flange F as a drive component of work drive 16 for rotation about work axis A. Milling drum 22 is connected to flange F in a detachable manner.

A protective shell 24 runs around milling drum 22 along a circumferential section at a radial distance relative to work axis A, in order to prevent the milling drum 22 with its cutting tools from being directly reachable from outside for reasons of work safety, and, likewise for reasons of work safety, to protect the surroundings U of the earth removal device 10 against grains of mineral and thus abrasive earth material that are removed in normal removal operation. Such removed grains have a very high kinetic energy immediately following removal.

With a back plate 26 likewise belonging to device housing 12, earth removal device 10 faces a self-propelled work vehicle V in the state in which it is accommodated on a self-propelled work vehicle V, which is shown in FIG. 1 merely in a rough schematic manner. Work vehicle V is symbolized by a machine frame M of work vehicle V, on which a manipulation frame R is accommodated in such a way that it is displaceable at least also in the direction of yaw axis Gi of work vehicle V. The machine frame M and the manipulation frame R movable relative to machine frame M together symbolize work vehicle V.

Between the work vehicle V and the back plate 26, a lateral displacement device 28 may be provided, by which the earth removal device 10 may be displaced parallel to work axis A and also parallel to pitch axis Ni of work vehicle V in translatory fashion over a displacement width that is specified by work vehicle V and/or by the lateral displacement device 28 itself. Back plate 26 in turn may be connected to the lateral displacement device so as to be swivable about an incline axis B that is parallel to the roll axis Ro of work vehicle V and/or orthogonal to work axis A, so that work vehicle V is able to perform a rolling motion about its roll axis without thereby disadvantageously influencing the earth removal device 10 during its earth removal operation. Incline axis B preferably intersects work axis A. Alternatively, incline axis B may cross work axis A, preferably at a distance of no more than half of the circle of intersection radius, in order to keep an incline arm between incline axis B and work axis A, which is effective in an inclination, advantageously short. Using an incline actuator that is not shown in the figures, it is possible specifically to incline the back plate and with it the work axis A about the incline axis B that is orthogonal to work axis A.

An incline mechanism that is not shown in the figures, which provides the incline mobility of base structure 30 about incline axis B, is preferably situated on lateral displacement device 28 for the joint displacement motion with base structure 30. This makes it possible to ensure that the relative axial position of incline axis B relative to work axis A does not change by an operation of lateral displacement device 28.

Incline axis B crosses or preferably intersects work axis A at the position of the axial longitudinal center of the respective removal tool. As a result, an inclination of the base structure at identical angles of inclination in terms of absolute value in both possible inclination directions starting from a neutral position at an angle of inclination of 0° and to the pitch axis Ni of the work vehicle V supporting the earth removal device 10 has an identical effect. This arrangement is quite fundamentally preferred and applies not only to the illustrated exemplary embodiment.

In the present case, the housing wall 14, the protective shell 24 and the back plate 26 are rigidly connected to one another and form a base structure 30, relative to which the milling drum 22 and the flange F are rotatably movable exclusively about the work axis A.

The first side plate 18 is shown in FIG. 1 in its maximally raised operating position relative to base structure 30. In an opening facing the ground surface G, milling drum 22 protrudes out of device housing 12 and thus forms an earth engagement area 23.

In the illustrated example, the first side plate 18 is designed in two parts and in FIG. 1 comprises an upper first lift component 32 and a lower first swivel component 34. The first swivel component 34 is supported on the first lift component 32 so as to be swivable about a first swivel axis P1. A first ground contact section 36 is integrally connected to the first swivel component 34, the first ground contact section 36 being in the present case developed as a skid 38 having a contact surface 40. With contact surface 40, the first swivel component 34 rests in a sliding manner on the surface G of the earth to be removed in an earth removal operation.

The swivel bearing of the first swivel component 34 directly on first lift component 32 comprises a first swivel pin 42 mounted on the first lift component 32, which penetrates through an opening of the first swivel component 34 that is not shown in FIG. 1 and which supports a head 44 as a locking section having a greater diameter than the first swivel pin 42 and than the opening on the first swivel component 34 through which the first swivel pin 42 penetrates. The swivel pin is thus roughly mushroom-shaped. The locking section prevents the first swivel component 34 from being axially withdrawn from the first lift component 32. The head 44 as the locking section thus absorbs transverse forces acting along the work axis A or along the first swivel axis P1 and retains the first swivel component 34 on the first lift component 32 even when these transverse forces are exerted.

The first swivel component 34 furthermore has a front first curved slot hole 46 and a rear first curved slot hole 48, whose common axis of curvature is the first swivel axis P1. The slot holes 46 and 48 completely penetrate through the first swivel component 34. A front first guide pin 50 and a rear first guide pin 52 also penetrate through the slot holes 46 and 48. These guide pins 50 and 52 are respectively mounted on the first lift component 32, penetrate with a sliding section through their respectively associated first slot hole 46 and 48 in a sliding manner and include at their free longitudinal end respectively a head 44 as a locking section. The guide pins 50 and 52 are thus also roughly mushroom-shaped. The heads 44 again have a greater diameter than the first guide pins 50 and 52 that support them, their diameter exceeding the width of the slot hole through which the respective guide pin 50 and 52 passes. The heads 44 thus retain the first swivel component 34 axially on the first lift component 32 and likewise absorb transverse forces along the work axis A or the first swivel axis P1.

The length of the extension of the shorter of the first slot holes 46 and 48 determines the maximally possible swivel angle of the first swivel component 34 relative to the first lift component 32 about the first swivel axis P1. To be sure, in the illustrated example, the first slot holes 46 and 48 are of equal length. The maximally possible swivel angle may also be referred to as a limited swivel angle. The guide pins 50 and 52 may also be referred to as protrusions 50 and 52. The slot holes 46 and 48 may also be referred to as recesses 46 and 48. The limited swivel angle may be described as being defined by a protrusion 50, 52 on one of the first lift component 32 and the first swivel component 34, the protrusion being received in a recess 46, 48 of the other of the first lift component 32 and the first swivel component 34.

The fact that the first swivel component 34 is able to swivel relative to the first lift component 32 makes it possible that the first ground contact section 36 with its contact surface 40 is able to maintain contact with the ground surface G even when the work vehicle V performs a pitching movement about its pitch axis Ni. As a result, the point of engagement of the milling drum 22 with the earth to be worked remains optimally shielded with respect to the surroundings U in the axial direction relative to the work axis A.

At its front end area, i.e. at the area further removed from work vehicle V, the first lift component 32 is secured in axially form-locking manner on base structure 30 by a bracket 54 embracing the first lift component 32 and at its rear end by a ledge 56 mounted on the back plate 26. Guide blocks 58 indicated by dashed lines guide the first lift component 32 along the straight translatory first lift path H1 relative to base structure 30. The first lift path H1 corresponds to the path generally referred to in the introduction to the description as a translatory "displacement path" and runs parallel to the guide direction specified by the slide or guide blocks 58. Guide blocks 58, which are situated in the present example on the side of the first lift component 32 facing away from the viewer of FIG. 1, are in sliding contact engagement with guide ledges 60 and 62 (see also FIG. 3) situated one above the other on the housing wall 14 and thus on the base structure 30. Deviating from the illustration, guide ledges 60 and 62 may also be implemented by a one-piece guide ledge component. Guide ledge 62 has an opening 63, through which the couplings 61*a* and 61*b* for connecting supply lines protrude, for example in order to connect the work drive 16 to a hydraulic fluid circuit. The couplings 61*a* and 61*b* also penetrate through the opening 20 of the first side plate 18 or first lift component 32. The aforementioned first guide distance or first guide clearance would be the maximum clearance between the guide blocks 58 and the guide ledges 60 or 62 in a direction perpendicular to the direction of the first lift path H1 in the plane of FIG. 4.

In the maximally raised position of the first lift component 32 and thus of the first side plate 18 shown in FIG. 1, the first swivel axis P1 is located below and at a distance from a threshold plane SE that is orthogonal to the first lift path H1 and contains the work axis A. Since starting from the position shown in FIG. 1, the first lift component 32 and thus the first side plate 18 is only able to be lowered in the direction toward ground surface G, the distance of the first swivel axis P1 from the threshold plane SE can only get larger. The threshold plane SE may also be described as being orthogonal to a direction H1 of the translatory displacement of the first lift component 32.

FIG. 1 also partially shows a first eccentric lever 64, from which a first lift pin 66 runs parallel to work axis A and thus parallel to the first swivel axis P1 and parallel to guide pins 50 and 52 and to swivel pin 42 through a slot hole 68 of the first lift component 32. The roughly mushroom-shaped first lift pin 66 also has a larger diameter head 44 on its free longitudinal end, so that the area of the lift component 32 having the slot hole 68 is retained in form-locking fashion between the eccentric lever 64 and the head 44 of lift pin 66.

The slot hole 68 runs essentially orthogonally to the first lift path H1.

Figure 2:
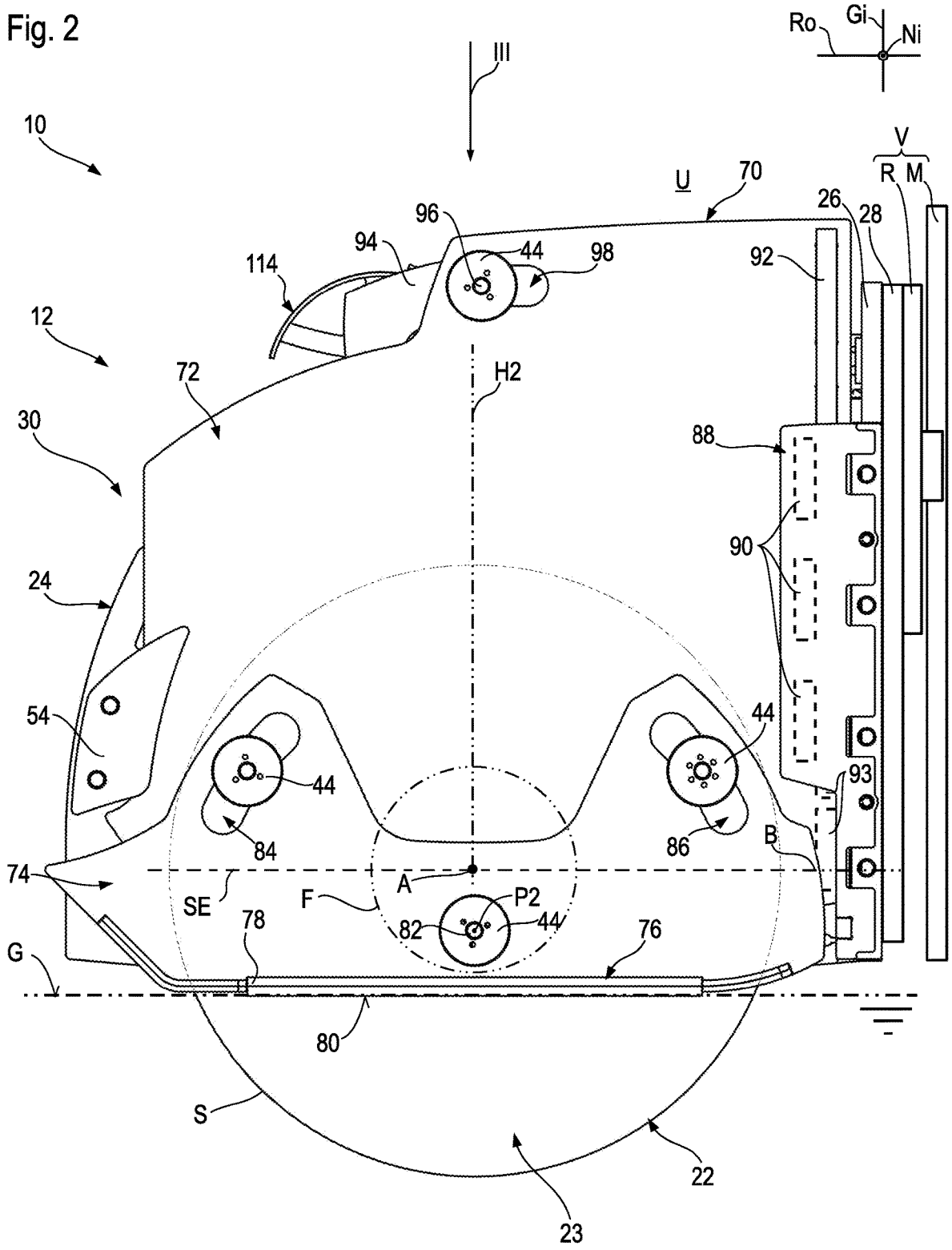

In a viewing direction that is parallel to work axis A, but opposite to the viewing direction of FIG. 1, FIG. 2 also shows the side of the earth removal device 10 axially opposite to the side shown in FIG. 1 in the same operating position of the earth removal device 10.

On this opposite side, the device housing has a second side plate 70, which is likewise divided into two parts and has a second upper lift component 72 in FIG. 2 and a lower second swivel component 74 hinged on it so as to be swivable about a second swivel axis P2. Like the first side plate 18, the second side plate 70 is also maximally raised relative to the base structure 30.

The second swivel component 74, which is preferably designed identically to swivel component 34 of the first side plate 18 and which is developed for use on opposite axial sides of the device housing 12 preferably in mirror symmetry with respect to a mirror symmetry axis orthogonal to swivel axes P1 or P2, has a second ground contact section 76.

Due to the identical design of the first swivel component 34 and of the second swivel component 74, for the description of the second swivel component 74, reference is made to the description of the first swivel component 34, which also applies to the second swivel component 74.

The second ground contact section 76 is also designed as a skid 78 having a contact surface 80 for sliding contact engagement with the surface G of the earth to be worked.

A second swivel pin 82 mounted on the second lift component 72, which protrudes from the second lift component 72 parallel to work axis A and to the second swivel axis P2, supports the second swivel component 74 on the second lift component 72 so that it is swivable about the second swivel axis P2. A front first slot hole 84 and a rear first slot hole 86 bound, in the manner already described, the maximally possible swivel range of the second swivel component 74 relative to the second lift component 72.

A bracket 54 embracing the second lift component 72, which is designed identically to the previously mentioned bracket 54 on the other axial side of the device housing 12, retains the second lift component 72 in its front area in a form-locking manner on the base structure 30. The rear area of the second lift component 72, which is situated closer to the back plate 26, is retained in a form-locking manner on the base structure 30 by a combined guide and support component 88 and is guided along the second lift path H2 for the translatory lift and lowering movement.

In the illustrated example, the first lift path H1 and the second lift path H2 are oriented in parallel to each other and orthogonally to the work axis A, so that each lift path H1 and H2 respectively also represents its projection along the work axis.

Slide or guide blocks 90 in the guide and support component 88 cooperate with a guide ledge 92 that is fixed on the lift component and runs parallel to the second lift path H2 on the side of the second lift component 72 facing the viewer of FIG. 2. Below the guide ledge 92, slide or guide blocks 93 are accommodated and mounted in second lift component 72 likewise in parallel to the second lift path H2, but on the side facing away from the viewer of FIG. 2. Thus, while the slide blocks 90 of the guide and support component 88 interact with the guide ledge 92 on the side of the second lift component 72 facing away from the base structure 30, the slide blocks 93 are situated between the second lift component 72 and the base structure 30, for example between the frame component 120 fixed on the base structure, mentioned further below in connection with FIG. 3, and the second lift component 72 in a sliding contact engagement with a groove formed in the frame component 120. The aforementioned second guide distance or second guide clearance would be the maximum clearance between the guide blocks 90 and the guide ledge 92 in a direction perpendicular to the direction of the second lift path H2 in the plane of FIG. 5.

The height adjustment of the second lift component 72 occurs as that of the first lift component 32 by way of a second eccentric lever 94, from which a second lift pin 96, likewise roughly mushroom-shaped in the illustrated example, protrudes parallel to the guide pins and the second swivel pin 82 and parallel to work axis A and to second swivel axis P2 and runs through a slot hole 98 in the second lift component 72, which slot hole 98 runs in exemplary fashion orthogonally to the second lift path H2, and is secured by a head 44.

While on the opposite axial side the work drive 16 is secured on the housing wall 14, which is orthogonal to work axis A, on the axial side of the device housing 12 situated closer to the viewer of FIG. 2, no essentially continuous housing wall belonging to base structure 30 is developed. After removal of the second side plate 70 from the base structure 30, the milling drum 22 is axially completely accessible. On the side facing the viewer of FIG. 2, the base structure 30 has an opening that is sufficiently large so that following the removal of the second side plate 70 from the base structure 30, the milling drum 22 may be removed axially from its receiving space in the device housing 12 and a milling drum 22 may be inserted axially into the receiving space and be connected to flange F in torque-transmitting fashion.

Although the two swivel axes P1 and P2 may be situated at different locations and thus in parallel to each other, but at a distance from each other, for example when the work vehicle V performs a rolling motion, the two swivel axes P1 and P2 will run coaxially when the removal depth or milling depth setting is the same on both side plates or when the work vehicle V is not experiencing a rolling motion. What was said above regarding the first swivel axis P1 applies for the position of the second swivel axis P2 relative to the threshold plane SE. The two swivel axes P1 and P2 preferably are always situated in a common plane running parallel to the first and to the second lift path H1 and H2, respectively.

Figure 3:
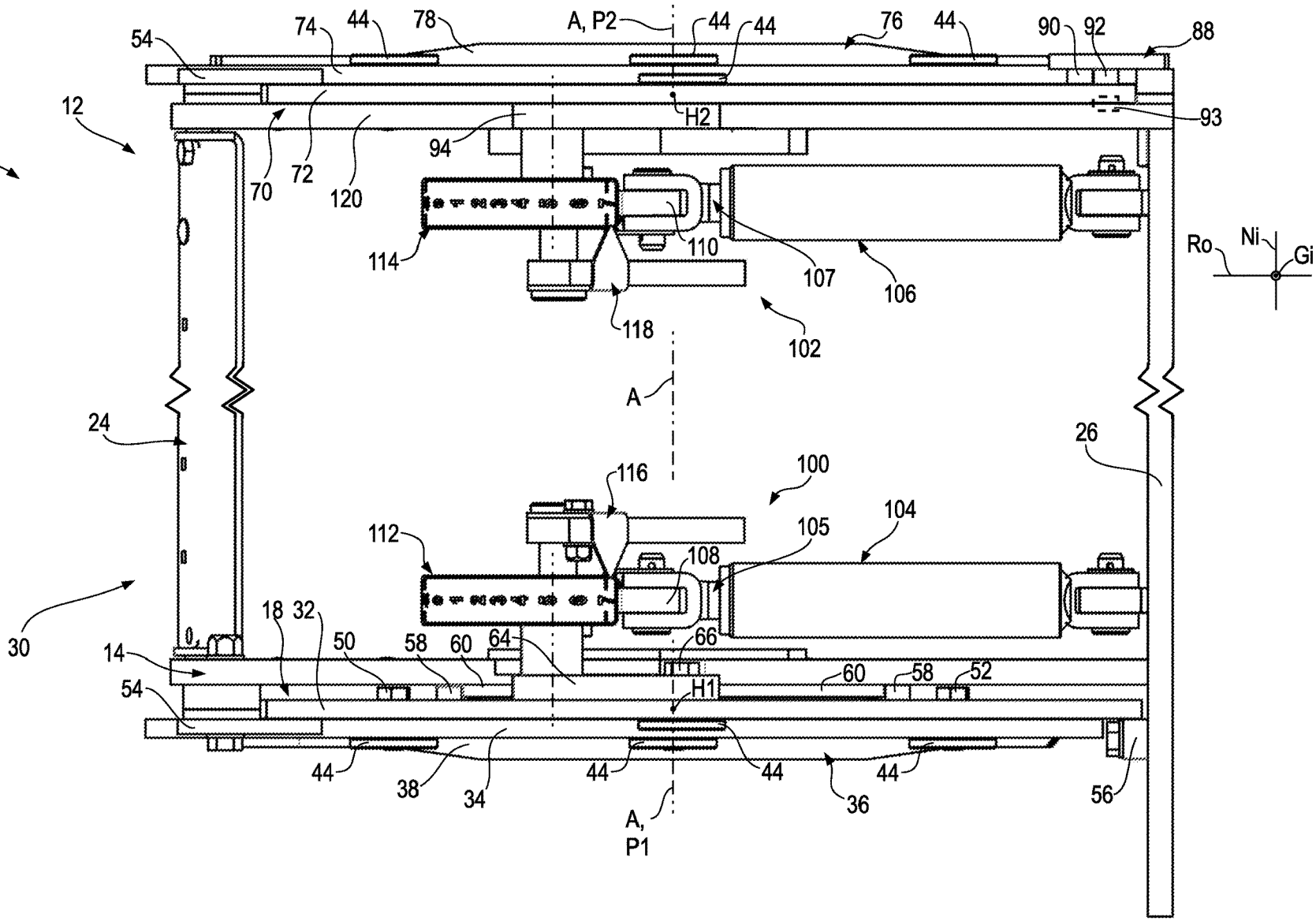

FIG. 3 shows a top view onto the earth removal device 10 according to the invention of FIGS. 1 and 2 when viewed along arrow III in FIGS. 1 and 2, that is, when viewed orthogonally to the work axis and orthogonally to the surface G of a ground area to be worked by the earth removal device 10. FIG. 3 shows essentially the axial end areas of the earth removal device 10. The protective shell 24 between these axial end areas is shown in a truncated manner, which is indicated by the zigzag lines. The work vehicle V and the lateral displacement device 28 are not shown in FIG. 3.

FIG. 3 shows a first and a second lift drive 100 and 102, respectively, including a first lift actuator 104 and a second lift actuator 106, which are not shown or shown only partially in FIGS. 1, 2, 4 and 5. The lift actuators 104 and 106 are piston-cylinder devices, which are hinged by their one, for example cylinder-side, longitudinal end on the back plate 26 and whose projecting longitudinal ends of piston rods 105 and 107 are respectively coupled to a first operating arm 108 of the first eccentric lever 64 and to a second operating arm 110 of the second eccentric lever 94. The lift actuators 104 and 106 are preferably controlled from the work vehicle V for actuator operation and supplied with fluid, in particular hydraulic fluid.

The first and the second lift drives 100 and 102 are essentially identical, but are constructed in mirror symmetry with respect to a mirror symmetry axis that is orthogonal to drive axis A. Each of the two lift drives 100 and 102 comprises a scale 112 and 114, respectively, which are movable with the respectively driven eccentric lever 64 and 94, each of which is movable jointly with its eccentric lever 64 and 94, respectively, relative to an indicator 116 and 118 fixed to the base structure. The operator of the work vehicle V is able to see and read this robust indicator of the respectively set removal depth from his operator platform. In FIG. 3, the indicators 116 and 118 indicate the maximum operating depth of 7 scale divisions.

On the side of the second side plate 70, between the protective shell 24 and the second side plate 70, a frame 120, fixed to the base structure, is rigidly connected to the protective shell 24. This frame 120 has the opening for the axial mounting and demounting of the milling drum 22 and supports the bracket 54 as well as the guide and support component 88.

Figure 4:
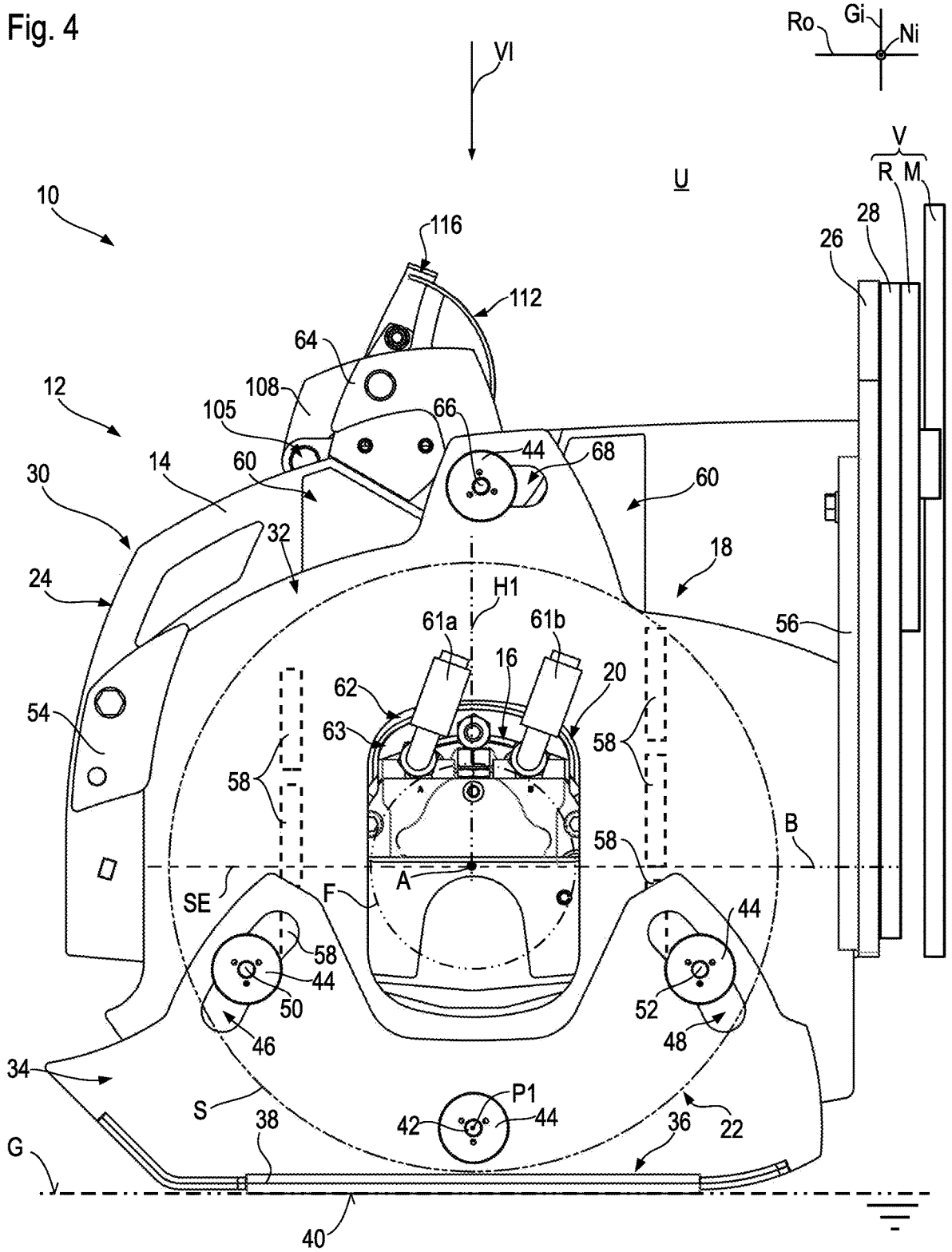

FIG. 4 shows the earth removal device 10 in the same perspective as in FIG. 1, but with maximally lowered first side plate 18. The cutting circle runs entirely within the device housing 12. The milling drum 22 is thus not able to remove earth.

Figure 5:
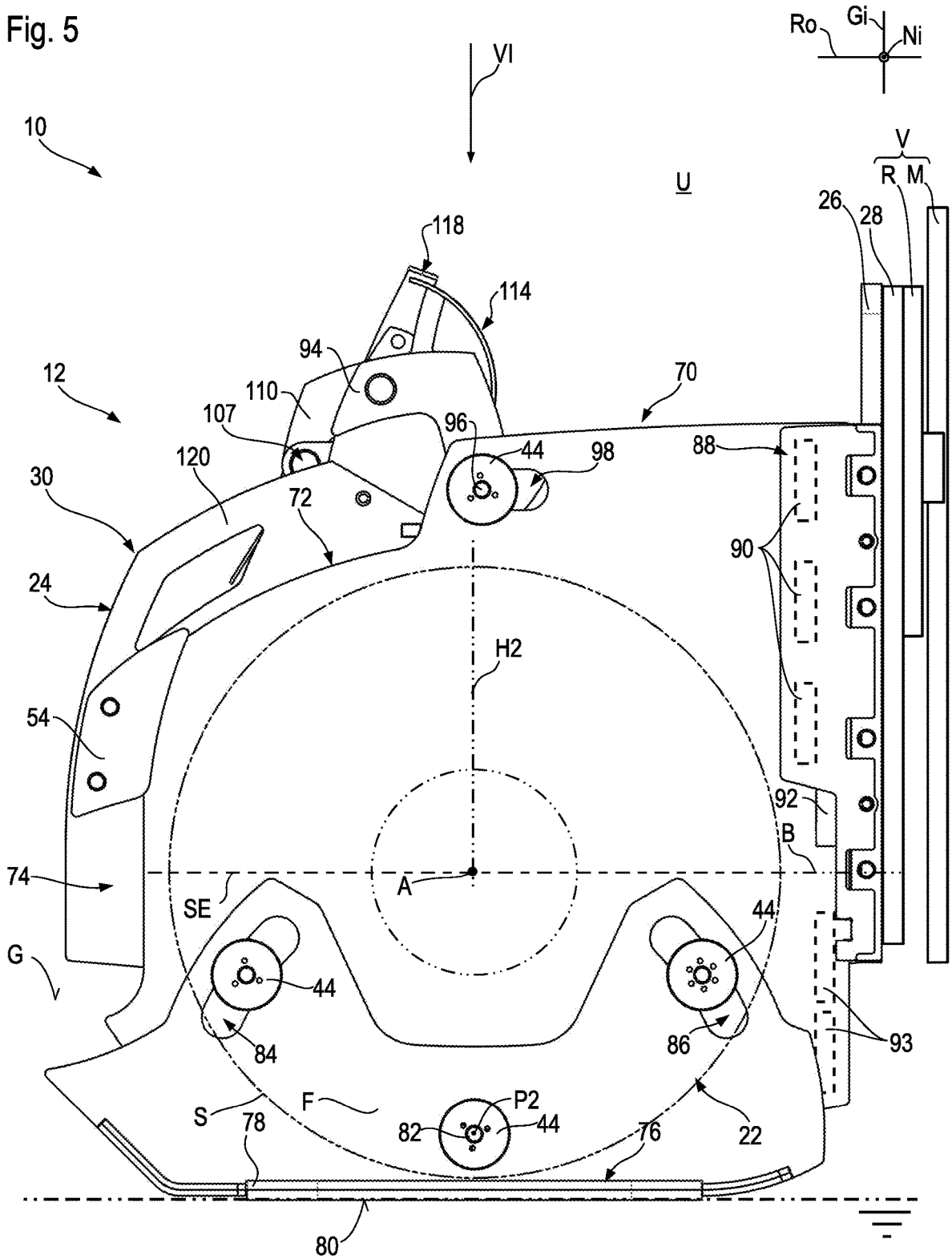

FIG. 5 shows the earth removal device 10 in the same perspective as FIG. 2, but with maximally lowered first side plate 70.

Figure 6:
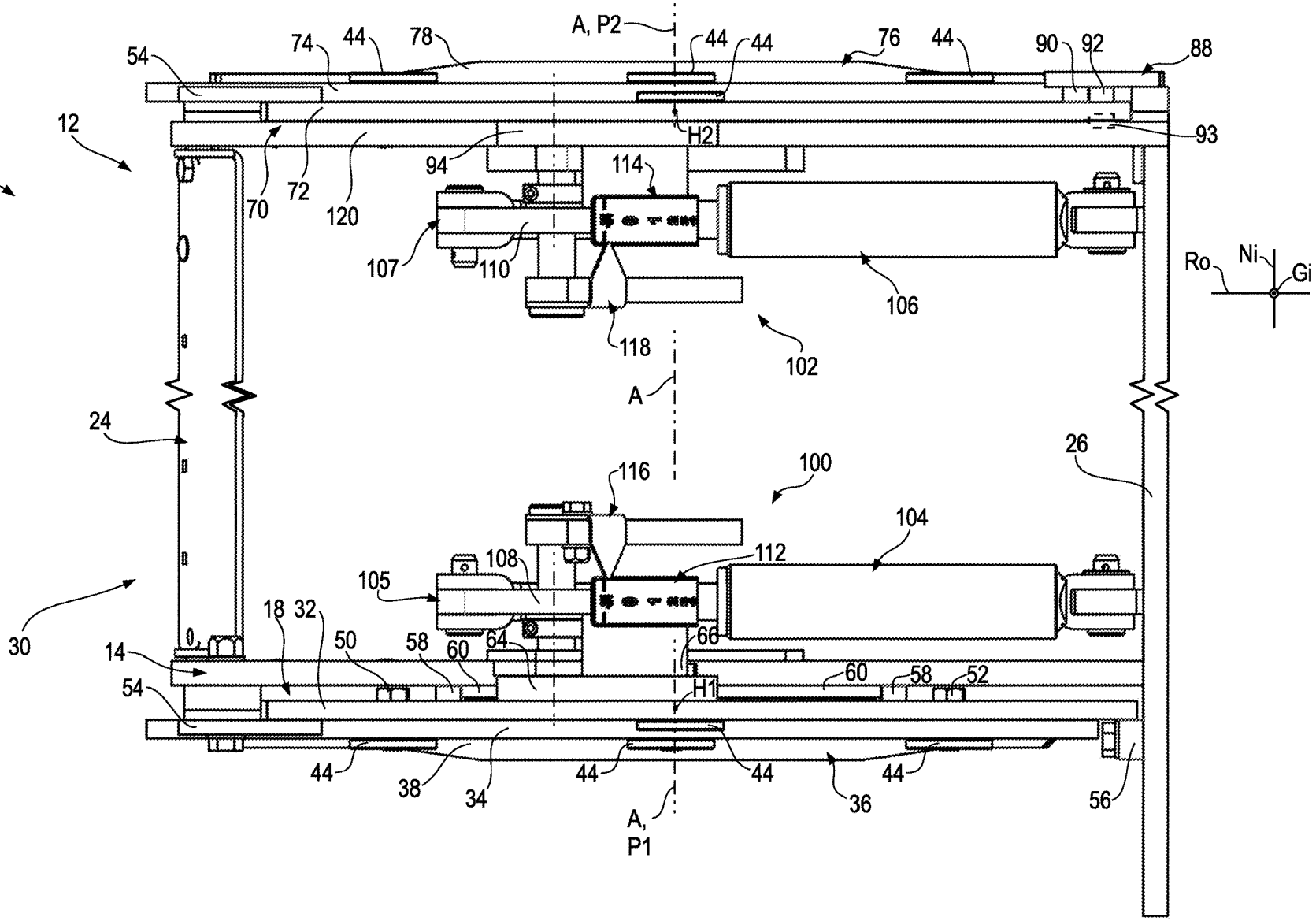

FIG. 6 shows the earth removal device 10 in the same perspective as FIG. 3, that is, along the direction of view VI in FIGS. 4 and 5. Since with regard to FIG. 3 the side plates 18 and 70 were merely moved orthogonally to the drawing plane of FIGS. 3 and 6, the illustration of side plates 18 and 70 in FIG. 6 is unchanged compared to that of FIG. 3. What has changed is merely the position of the lift actuators 104 and 106, whose piston rods 105 and 107 are now fully extended. Consequently, the relative position of the eccentric levers 64 and 94 has changed as well, which were swiveled about a swivel axis parallel to the work axis A and to the swivel axes P1 and P2. Accordingly, the relative position between the scales 112 and 114 and their respective interacting indicators 116 and 118 has changed, in order to indicate to an operator working in the work vehicle V the currently set removal depth, which is in this case 0.

The invention claimed is:

1. An earth removal device for releasable mounting on a work vehicle, the earth removal device comprising:

a device housing including a base structure, the base structure including a support part;

a removal tool mounted within the device housing for rotation about a work axis defining an axial direction running along the work axis, radial directions running orthogonally to the work axis and a circumferential direction running about the work axis;

a work drive mounted on the support part of the device housing and having an output component designed both for torque-transmitting coupling to the removal tool rotating in removal operation as well as for rotation about the work axis;

wherein the device housing further includes a first side plate running crosswise to the work axis and a second side plate running crosswise to the work axis at an axial distance from the first side plate, the first side plate including a first ground contact section and the second side plate including a second ground contact section, each of the first and second ground contact sections being configured for contact with the earth to be worked during earth removal work;

wherein at least one of the first and second side plates is a multipart side plate including a lift component and a swivel component, the lift component being displaceable relative to the base structure in translatory fashion crosswise with respect to the work axis, and the swivel component being displaceable in translatory fashion together with the lift component and being swivable through a limited swivel angle about a swivel axis relative to the lift component, the ground contact section of the multipart side plate being connected to the lift component by the swivel component; and wherein the swivel axis in a translatory displacement of the lift component across an entire normal displacement path of the lift component is always below a threshold plane containing the work axis, the threshold plane being orthogonal to a direction of the translatory displacement of the lift component.

2. The earth removal device of claim 1, wherein:

the limited swivel angle is defined by a protrusion on one of the lift component and the swivel component, the protrusion being received in a recess of the other of the lift component and the swivel component.

3. The earth removal device of claim 1, wherein:

the lift component includes first and second guide pins received in first and second slot holes of the swivel component, and the limited swivel angle is defined by a length of a shorter one of the first and second slot holes.

4. The earth removal device of claim 1, wherein:

a surface of the swivel component facing away from the base structure in a direction of the swivel axis is less than 40% of a surface of the lift component facing away from the base structure in the direction of the swivel axis.

5. The earth removal device of claim 1, wherein:

a surface of the swivel component facing away from the base structure in a direction of the swivel axis is less than 30% of a surface of the lift component facing away from the base structure in the direction of the swivel axis.

6. The earth removal device of claim 1, wherein:

the swivel component is supported on the lift component so as to be swivable about the swivel axis.

7. The earth removal device of claim 1, wherein:

the swivel component of the multipart side plate includes the ground contact section of the multipart side plate.

8. The earth removal device of claim 1, wherein:

the lift component of the multipart side plate is guided on the base structure in translatory displaceable fashion.

9. The earth removal device of claim 1, wherein:

the lift component of the multipart side plate is translatable perpendicular to the work axis.

10. The earth removal device of claim 1, wherein:

the swivel axis is oriented in parallel or coaxially to the work axis.

11. The earth removal device of claim 1, wherein:

the lift component is only translatable relative to the base structure and the swivel component is only swivable relative to the lift component.

12. The earth removal device of claim 1, further comprising:

a lift actuator supported from the base structure and operably associated with the lift component to translate the lift component in opposite directions.

13. The earth removal device of claim 1, wherein:

the swivel component is supported on the lift component so as to be passively swivable relative to the lift component.

14. The earth removal device of claim 1, wherein:

the at least one of the first and second side plates being a multipart side plate includes both of the first and second side plates.

15. The earth removal device of claim 1, wherein:

the lift component of the first side plate is supported in translatory displaceable fashion relative to the base structure by a first linear guide structure, the first linear guide structure having a first guide clearance in a direction perpendicular to the direction of the translatory displacement of the lift component of the first side plate; and the lift component of the second side plate is supported in translatory displaceable fashion relative to the base structure by a second linear guide structure, the second linear guide structure having a second guide clearance in a direction perpendicular to the direction of the translatory displacement of the lift component of the second side plate, the first guide clearance differing from the second guide clearance in terms of absolute value.

16. The earth removal device of claim 1, wherein:

the ground contact section includes rollers and/or a skid.

17. The earth removal device of claim 1, further comprising:

a coupling assembly configured for releasable coupling of the earth removal device to a self-propelled work vehicle, the coupling assembly being connected to the base structure so as to be movable relative to the base structure.

18. A self-propelled work vehicle having the earth removal device of claim 1 releasably coupled to the work vehicle.

19. An earth removal device for releasable mounting on a work vehicle, the earth removal device comprising:

a device housing including a base structure, the base structure including a support part;

a removal tool mounted within the device housing for rotation about a work axis defining an axial direction running along the work axis, radial directions running orthogonally to the work axis and a circumferential direction running about the work axis;

a work drive mounted on the support part of the device housing and having an output component designed both for torque-transmitting coupling to the removal tool rotating in removal operation as well as for rotation about the work axis;

wherein the device housing further includes a first side plate running crosswise to the work axis and a second side plate running crosswise to the work axis at an axial distance from the first side plate, the first side plate including a first ground contact section and the second side plate including a second ground contact section, each of the first and second ground contact sections being configured for contact with the earth to be worked during earth removal work;

wherein at least one of the first and second side plates is a multipart side plate including a lift component and a swivel component, the lift component being displaceable relative to the base structure in translatory fashion crosswise with respect to the work axis, and the swivel component being displaceable in translatory fashion together with the lift component and being swivable through a limited swivel angle about a swivel axis relative to the lift component, the ground contact section of the multipart side plate being connected to the lift component by the swivel component; and wherein the lift component includes first and second guide pins received in first and second slot holes of the swivel component, and the limited swivel angle is defined by a length of a shorter one of the first and second slot holes.

20. The earth removal device of claim 19, wherein: the first and second slot holes are curved slot holes.

21. The earth removal device of claim 19, wherein: the first and second slot holes are of equal length.

* * * * *